US005890366A

United States Patent [19]

Yang

[11] Patent Number: 5,890,366

[45] Date of Patent: Apr. 6, 1999

[54] HIGH LEVEL OXYGEN AIR CONDITIONING

[76] Inventor: Sam X. Yang, 12001 Cherry St., Los Alamitos, Calif. 90720

[21] Appl. No.: 827,963

[22] Filed: Apr. 21, 1997

[51] Int. Cl.[6] ..... F24F 3/16

[52] U.S. Cl. ..... 62/78; 62/6; 62/642; 62/908

[58] Field of Search ..... 62/78, 641, 642, 62/908

[56] References Cited

U.S. PATENT DOCUMENTS

| | | | |
|---|---|---|---|
| 3,415,310 | 12/1968 | Kuhlmann | 62/78 |
| 3,750,556 | 8/1973 | Duke et al. | 62/78 X |
| 3,758,029 | 9/1973 | Yoshida | 62/78 X |
| 4,896,514 | 1/1990 | Sugiyama et al. | 62/78 X |
| 5,170,637 | 12/1992 | Shyu | 62/78 X |
| 5,259,553 | 11/1993 | Shyu | 62/78 X |

*Primary Examiner*—Christopher B. Kilner

[57] ABSTRACT

This invention relates to a process for Heating, Ventilating and Air Conditioning (HVAC) applications. In particular, this invention relates to a method for supplying oxygen concentrated air to an indoor air environment, which is termed as High Level Oxygen Air Conditioning (HLOAC): The High Level Oxygen Air Conditioning (HLOAC) primarily comprises three steps: (1). Introducing air stream to an oxygen and nitrogen separation device; (2). Separating nitrogen and oxygen in air to obtain a concentrated oxygen stream; (3). Introducing said concentrated oxygen stream into the indoor environment.

13 Claims, 2 Drawing Sheets

HIGH LEVEL OXYGEN AIR CONDITIONING

BACKGROUND

1. Field of Invention

This invention relates to a process for Heating, Ventilating and Air Conditioning (HVAC) applications. In particular, this invention relates to a method for supplying oxygen concentrated air to an indoor air environment, which is termed as High Level Oxygen Air Conditioning (HLOAC). So called indoor environment is hereby defined as enclosures surrounding where humans live, travel, work, and entertain themselves such as residential housings, commercial buildings, workshops, cars, boats, airplanes and so on.

Modern civilization is being accelerated in parallel with the rapid development of high technologies. In co this society, people are spending less time in an ambient environment. Many activities have shifted from outdoor to indoor environment. The indoor environment is being created to be equal or better than to ambient environment. Meanwhile, the air quality and oxygen standards are of our concerns.

Oxygen is a colorless, odorless, tasteless gas. Natural oxygen is primarily produced through photosynthesis. Green plants, which contain chlorophyll, absorb the solar radiation energy, break apart carbon dioxide and water, and give off free oxygen molecules. The excess oxygen beyond the essential respiration of the plant tissues is returned to the atmosphere and maintain a balance of oxygen content in the atmosphere. 99.8% of the natural oxygen occurs as the isotope of atomic weight of 16. The rest is in the form of the isotope of mass 18. There are trace isotopes with the atomic number of 15, 17, and 19. Oxygen constitutes of around 21% by volume of the dry ambient air composition, about 50% by weight of the earth's crust, and 60% of the human body. Oxygen can be produced through chemical reactions by decomposing oxygen-contained compounds i.e. electrolytically decomposition of water, or chemical decomposition of mercury oxide or potassium chlorate. It can also be obtained by physical separation of nitrogen and oxygen from air.

It has happened nowadays that ambient air ventilation in indoor environment with intensive activities is not enough to maintain necessary oxygen level. The natural oxygen level is no longer the optimum condition for some special environments. Where there is significant indoor and outdoor temperature differentials, some facilities use large volume internal air recirculation which can result in low indoor oxygen level. For intensive working and/or entertaining environments such as conference rooms, gymnasiums and others, a higher level of oxygen is desired.

On the other hand, our bodies now receive less oxygen from what we eat and drink due to over processed fast foods and unbalanced diets. We need to inhale more oxygen. Lack of oxygen causes distraction, headaches, nausea, even dozing off. It also impairs decision making, reduces work performance and efficiency. Under low level of oxygen environment, the creativity, productivity and enjoyment level are deteriorated. Humans can sustain without food and water and can not survive without oxygen even for few minutes. Without a constant supply of abundant oxygen, the human body can not effectively combat disease or remove toxins. Dr. Arthur C. Guyton, M.D. in his textbook of Medical Physiology states "all chronic pain, suffering and diseases are caused from a lack of oxygen at the cell level. " Dr. F. M. Eugene Blass, in his "Oxygen Therapy: Its Foundation, Aim & Results" points out that "oxidation is the source of life. Its lack causes impaired health or disease, it's cessation, death".

2. Description of Prior Art

Air Conditioning is a general practice to preserve the indoor air quality, which is defined as the adjustment of air properties such as temperature, pressure, humidity, motion, distribution, dust, bacteria, odors and toxic gases. By healthy and building codes, typical HVAC system contains air purification (filtration), temperature conditioning (heating or cooling), humidifying and dehumidifying, ventilating while minimizing the size of the mechanical and electrical equipment and maximizing energy efficiency. However, all HVAC practice in the past has not paid attention to a higher oxygen level in indoor environment even though oxygen is critically important to humans living standards.

While Oxygen is the most abundant natural substance, high purity oxygen has been considered to be a relatively expensive chemical for general purposes. It has never had high level oxygen for an in-door air conditioning practice.

What I found is that indoor environment can often be improved by supplying concentrated oxygen source instead of traditional ambient air source. Living in a high level of oxygen environment help humans inhale more oxygen. The delivery of abundance of oxygen to brain and tissues can improve the work efficiency, the creativity, productivity and entertainment level. The HLOAC is also applicable to small cabins such as cars, airplanes, boats, and indoor environments where there exist intensive physical activities, mental activities and crowds.

By designing a simple molecular sieve adsorber for indoor High Level Oxygen Air Conditioning, this HLOAC process can be applied to many air conditioning systems.

SUMMARY OF THE INVENTION

The High Level Oxygen Air Conditioning (HLOAC) primarily comprises three steps

Introducing air stream to an oxygen and nitrogen separation device

Separating nitrogen and oxygen in air to obtain a concentrated oxygen stream

Introducing said concentrated oxygen stream into the indoor environment

BRIEF DESCRIPTION OF THE DRAWINGS

The High Level Oxygen Air Conditioning (HLOAC) process is described in accordance to the flow sheet in FIG. 1.

DETAILED DESCRIPTION OF THE INVENTION

Figure 1:
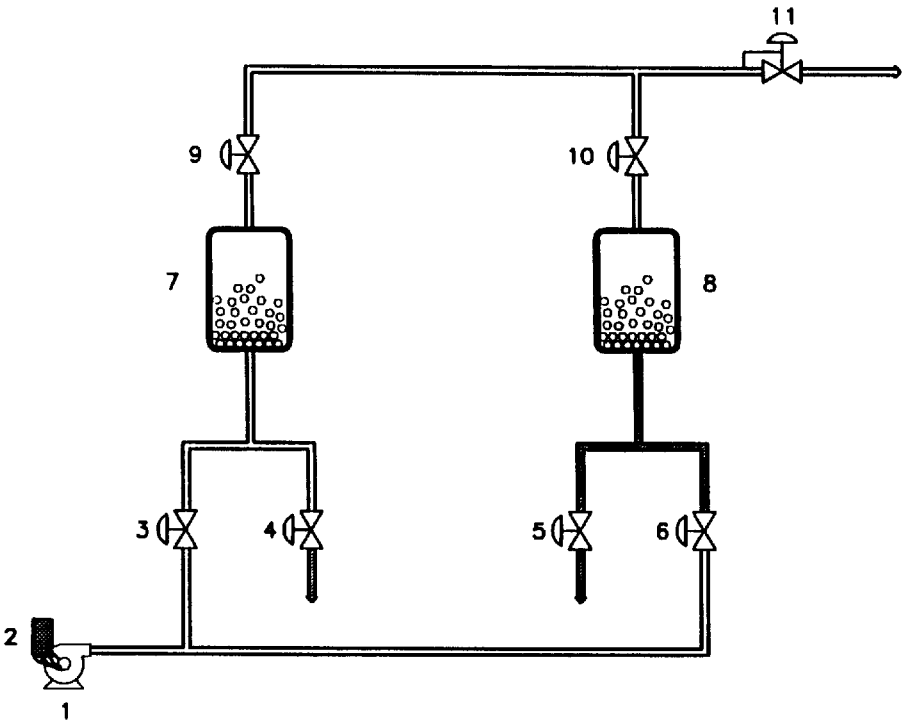

A typical flow diagram of the present invention is illustrated in FIG. 1. The major equipment comprises air supply blower 1, air filter/dryer 2, inlet isolation valves 3, 4, 5 and 6, molecular sieve absorbers 7 & 8, outlet isolation valves 9 & 10, and pressure control valve 11.

Figure 2:
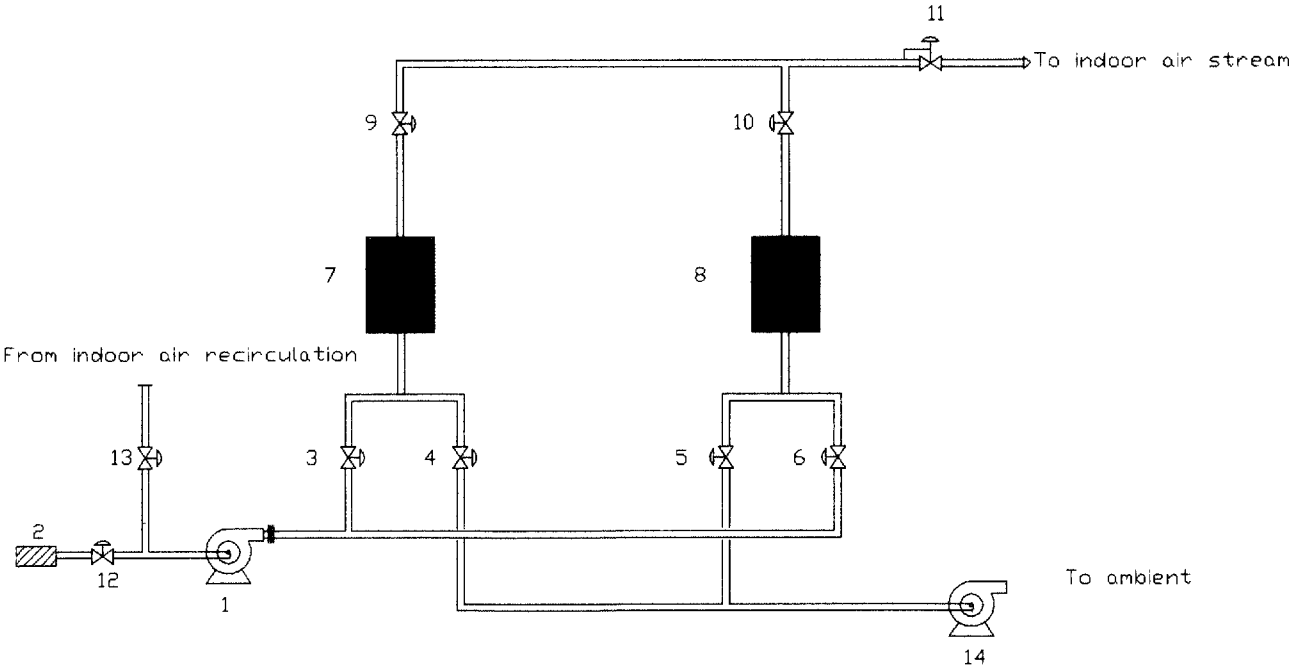
FIG. 2 discloses a recirculation embodiment.

A typical flow diagram with air recirculation is illustrated in FIG. 2. The major equipment comprises air supply blower 1, air filter/dryer 2, inlet isolation valves 3, 4, 5 and 6, molecular sieve absorbers 7 & 8, outlet isolation valves 9 & 10, pressure control valve 11, ambient air inlet valve 12, recirculation air inlet valve 13 and vacuum pump 14.

This process separates oxygen and nitrogen from air through adsorption and desorption of nitrogen by molecular sieve which is made of synthetic zeolite. The molecular sieve attracts nitrogen at higher pressure (and/or low temperature) and desorbs or releases the nitrogen at lower pressure (and/or high temperature). The air source can be either from ambient air or indoor air recirculation.

In this process, ambient air is filtered and dried at filter and dryer 2 and supplied at a pressure ranging from 0 to 50 psig by blower 1. The air is introduced to one of two parallel molecular sieve absorbers 7 or 8. The molecular sieve attracts and absorbs nitrogen and leaves oxygen pass though. Concentrated oxygen flows out of the bed 7 or 8 to the indoor air. This continues until the molecular sieve bed is saturated with nitrogen. The air flow is then diverted to the second absorber and the first absorber is then regenerated by reducing the pressure and venting the nitrogen to the atmosphere. The concentrated oxygen air stream is introduced into the indoor air system.

The isolation valves are provided for switching molecular sieve bed. The oxygen gas pressure and molecular sieve bed pressure is controlled by the pressure control valve 11.

Although the description above contains some specifics, these should not be construed as limiting the scope of the invention but as merely providing illustrations of some of the presently preferred embodiments of this invention. Thus the scope of the invention should be determined by the appended claims and their legal equivalents, rather than by the examples given above.

The reader will be acknowledged that a crucial improvement in HVAC by dosing high level oxygen content in air conditioning. For the first time, the indoor air can be fresher than natural air by using higher oxygen level in indoor air treatment. High level oxygen environment increase the creativity and a productivity and provides pleasure for entertainment. It is a feasible approach that using molecular sieve absorber generates oxygen for the indoor air conditioning.

The significance of this invention includes:

High Level Oxygen Air Conditioning provides the possibility to provide fresher air than ambient air for indoor environment by using a high level oxygen (greater than 21% by volume) conditioning.

High Level Oxygen Air Conditioning provides concentrated oxygen and reducing the air flow up to 80% and therefore reducing 80% by maximum for all HVAC equipment and duct size.

High Level Oxygen Air Conditioning can take full advantages of internal air recirculation. In some cases, the recirculation volume can be reduced and the heating and cooling energy can be reduced.

High Level Oxygen Air Conditioning is especially applicable for area where the ambient pressure and oxygen level are both lower than standard temperature and pressure (21% by volume oxygen at 0° C. and 1 atmosphere).

High Level Oxygen Air Conditioning provides concentrated oxygen for intensive working environment and/or entertaining environment such as conference rooms, gymnasiums, and others to increase the creativity and productivity and pleasure for entertainment.

What is claimed is:

1. A process for Heating, Ventilating, Air Conditioning by introducing concentrated oxygen stream into indoor air conditioning, which comprises three steps:

a) introducing an air stream to an oxygen and nitrogen separation device b) separating oxygen from nitrogen in said oxygen and nitrogen separation device to obtain a concentrated oxygen air stream c) introducing said concentrated oxygen stream into indoor environment to create an indoor oxygen level from around 21% to 100% by dry volume wherein said air stream is introduced from an indoor air recirculation stream.

2. The process according to claim 1 wherein said oxygen and nitrogen separation device contains at least two zeolite adsorbers and operates alternatively.

3. The process according to claim 1 wherein said air stream in said step (a) is introduced partially from an indoor air recirculation source or partially from ambient air source.

4. The process according to claim 1 wherein said step (b) takes place under an operating pressure of approximate 0–50 psig.

5. The process according to claim 1 wherein said concentrated oxygen stream in step (c) is mixed with other air stream before being introduced to said indoor environment.

6. The process according to claim 1 wherein said oxygen and nitrogen separation device is regenerated under vacuum pressure.

7. A process for air conditioning in a vehicle by introducing concentrated oxygen stream into air conditioning, the process comprising a) introducing an air stream to an oxygen and nitrogen separation device b) separating oxygen from nitrogen in said oxygen and nitrogen separation device to obtain a concentrated oxygen air stream c) introducing said concentrated oxygen stream into indoor environment to create an indoor oxygen level from around 21% to 100% by dry volume.

8. The process according to claim 7 wherein said vehicle includes automobile, boat, aircraft, train, and other transportation and conveying means.

9. The process according to claim 7 wherein said oxygen and nitrogen separation device contains at least two zeolite adsorbers.

10. The process according to claim 7 wherein said air stream in said step (a) is introduced partially from an indoor air recirculation source or partially from ambient air source.

11. The process according to claim 7 wherein said step (b) takes place under an operating pressure of approximate 0–50 psig.

12. The process according to claim 7 wherein said concentrated oxygen stream in step (c) is mixed with other air stream before being introduced to said indoor environment.

13. The process according to claim 7 wherein said oxygen and nitrogen separation device is regenerated under vacuum pressure.

* * * * *